US005980066A

United States Patent [19]

Belliveau et al.

[11] Patent Number: 5,980,066

[45] Date of Patent: Nov. 9, 1999

[54] LIGHTING SYSTEM WITH MULTIPLE BEAM SHAPES

[75] Inventors: Richard S. Belliveau; John W. Lane, II, both of Autsin, Tex.

[73] Assignee: High End Systems, Inc., Austin, Tex.

[21] Appl. No.: 08/868,693

[22] Filed: Jun. 4, 1997

[51] Int. Cl.[6] ..... F21V 17/02

[52] U.S. Cl. ..... 362/281; 362/283; 362/284; 362/323; 362/324

[58] Field of Search ..... 362/268, 281, 362/283–287, 276, 293, 322–324, 331, 428, 802

[56] References Cited

U.S. PATENT DOCUMENTS

| | | | |
|---|---|---|---|
| 1,715,578 | 6/1929 | Terry et al. | 362/284 |
| 1,871,551 | 8/1932 | O'Brien | 362/284 |
| 2,475,365 | 7/1949 | Walsh | 362/284 |
| 3,260,152 | 7/1966 | Aston | 355/35 |
| 4,701,023 | 10/1987 | Hager et al. | 359/641 |
| 4,914,556 | 4/1990 | Richardson | 362/293 |
| 4,945,459 | 7/1990 | Farren et al. | 362/284 |
| 4,984,143 | 1/1991 | Richardson | 362/293 |
| 5,282,121 | 1/1994 | Bornhorst et al. | 362/294 |
| 5,319,528 | 6/1994 | Raven | 362/553 |
| 5,504,554 | 4/1996 | Dreyer et al. | 353/38 |
| 5,513,083 | 4/1996 | Chang | 362/284 |
| 5,665,305 | 9/1997 | Belliveau et al. | 362/268 |

*Primary Examiner*—Alan Cariaso

[57] ABSTRACT

Overlapping lenses for use in a light fixture provided to project a beam of light in a first beam shape having a first cross-sectional geometry. A first lens device is supported in the fixture and movable into a position to interrupt the beam of light for selecting beam shape by altering the first projected beam shape from the first cross-sectional geometry to a second cross-sectional geometry different from the first geometry. The first lens device includes at least one lenticular lens element having lens lenticules oriented in a first direction. A second lens device, separate from the first device, is supported in the fixture and movable into a position to interrupt the beam of light for selecting beam shape by altering the second projected beam shape from the second cross-sectional geometry to a third cross-sectional geometry different from the first and second geometries. The second lens device includes another lenticular lens element overlapping the one lenticular lens element of the first lens device and has lenticules oriented in a second direction, different from the first direction. The lens elements may be carried by discs rotatably mounted in the fixture. Each disc may carry a plurality of lens elements which can be combined by overlapping to change beam angle and beam shape.

7 Claims, 12 Drawing Sheets

LIGHTING SYSTEM WITH MULTIPLE BEAM SHAPES

FIELD OF THE INVENTION

This invention relates generally to stage and theater lighting fixtures and more particularly to a color wash luminaire which provides variable intensity, variable color, variable positioning and variable beam shapes and angles in a single compact fixture.

BACKGROUND OF THE INVENTION

Wash lights, as they are generally known, are used to provide uniform illumination and coloration to a theatrical set. Lights used in a studio or for photographic purposes often project a round cross-sectional pattern of light such as that seen by the ordinary flashlight. Simple devices utilize a reflector and a lamp or utilize sealed beam lamps, such as automotive head light type lamps. These sealed lamps consist of a reflector, a lamp and a type of diffuser or lens to soften the projected spot, and sometimes to focus the projected spot from either a narrow spot or a wide flood. More complicated arrangements involve ellipsoidal reflectors or condensing systems which focus light through an aperture which is imaged by projector lenses.

These types of systems commonly produce a more uniform beam of light than that of the sealed beam type. Other types of lights used include fresnel projectors, which utilize a fresnel projecting lens. The fresnel projecting lens is known to provide a beam of light that is homogenous with a gradual rolloff of light output toward the edges. Many of the things illuminated on a stage of studio do not always require a round beam of light since many stages or studio sets can often be more wide than they are tall. Illuminated subject areas often require the use of a framing projector or devices known as barn doors which can be utilized to change cross-sectional pattern or the shape of the beam by shadowing the light projected from the device as a means to change the shape of the beam.

The foregoing illustrates limitations of the known prior art. Thus it is apparent that it would be advantageous to provide alternatives directed to overcoming one or more of the limitations as set forth above. Accordingly, suitable alternatives are provided including features and benefits more fully disclosed hereinafter.

SUMMARY OF THE INVENTION

In one aspect of the present invention this is accomplished by providing overlapping lenses for use in a light fixture provided to project a beam of light. The beam projects a first beam shape having a first cross-sectional geometry. A first lens device including at least one lenticular lens element, is supported in the fixture and is movable into a position to interrupt the beam of light for altering the first projected beam shape from the first cross-sectional geometry to a second projected beam shape having a second cross-sectional geometry different from the first geometry. A second lens device, separate from the first lens device and including another lenticular lens element overlapping the one lenticular lens element of the first lens device, is supported in the fixture and is movable into a position to interrupt the beam of light for altering the second projected beam shape from the second cross-sectional geometry to a third projected beam shape having a third cross-sectional geometry different from the first and second geometries.

In another aspect of the present invention, this is accomplished by providing a light fixture including the overlapping lenses. The light fixture may be a moving light fixture and may be of the type including a yoke and means for movably suspending the yoke from a support. A housing is movably connected to the yoke and has a portion including a light source and means for removing heat generated from the light source. Another portion includes a plurality of movable color filters and the overlapping lenses, the light source being operable to project a beam along a path through the color filters and the lens devices. One of the lenses includes a lenticular lens element having a plurality of lenticules oriented in a first direction and the other of the lenses includes a lenticular lens element having a plurality of lenticules oriented in a second direction, different from the first direction.

In a further aspect of the present invention, this is accomplished by providing a light fixture having multiple lens apparatus for changing a shape projected by a beam of light comprising means for projecting a circular beam of light, and overlapping lens devices each including a lenticular lens element movable into a position to interrupt the beam of light for selecting beam shape by altering a circular beam pattern to ellipsoidal beam patterns and for moving the ellipsoidal beam patterns to a desired orientation.

The foregoing and other aspects will become apparent from the following detailed description of the invention when considered in conjunction with the accompanying drawing figures. It is to be expressly understood, however, that the figures are not intended as a definition of the invention but are for the purpose of illustration only.

BRIEF DESCRIPTION OF THE DRAWING FIGURES

DETAILED DESCRIPTION OF THE INVENTION

This invention includes overlapping rotating lens devices each including lenticular lens elements movable into a position to interrupt the beam of light for selecting beam shape by altering a circular beam pattern to ellipsoidal beam patterns and for moving the ellipsoidal beam patterns to a desired orientation.

Figure 1:
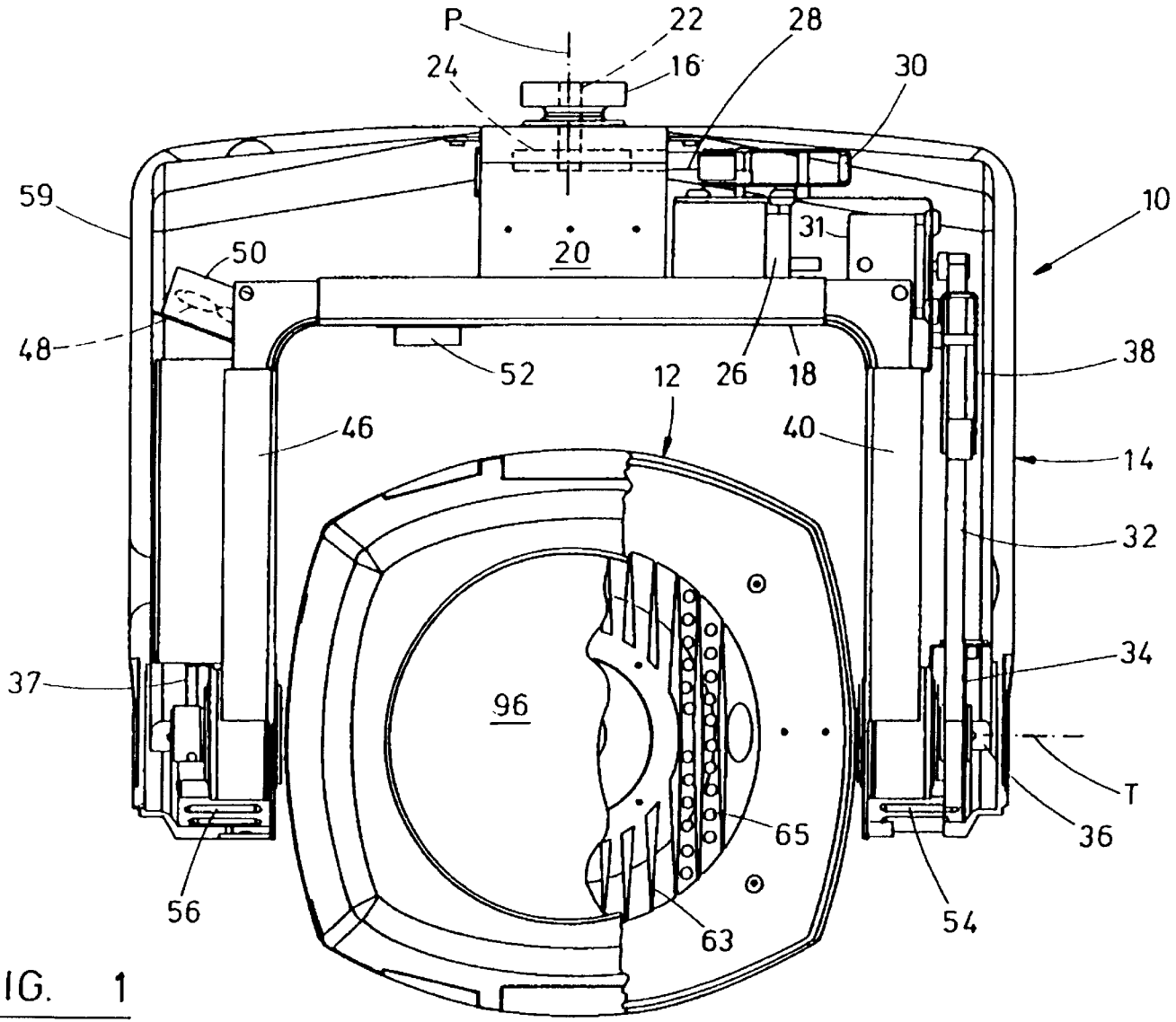
FIG. 1 is a frontal view, with partial cutaway portions, illustrating an embodiment of the luminaire of this invention.
Figure 2:
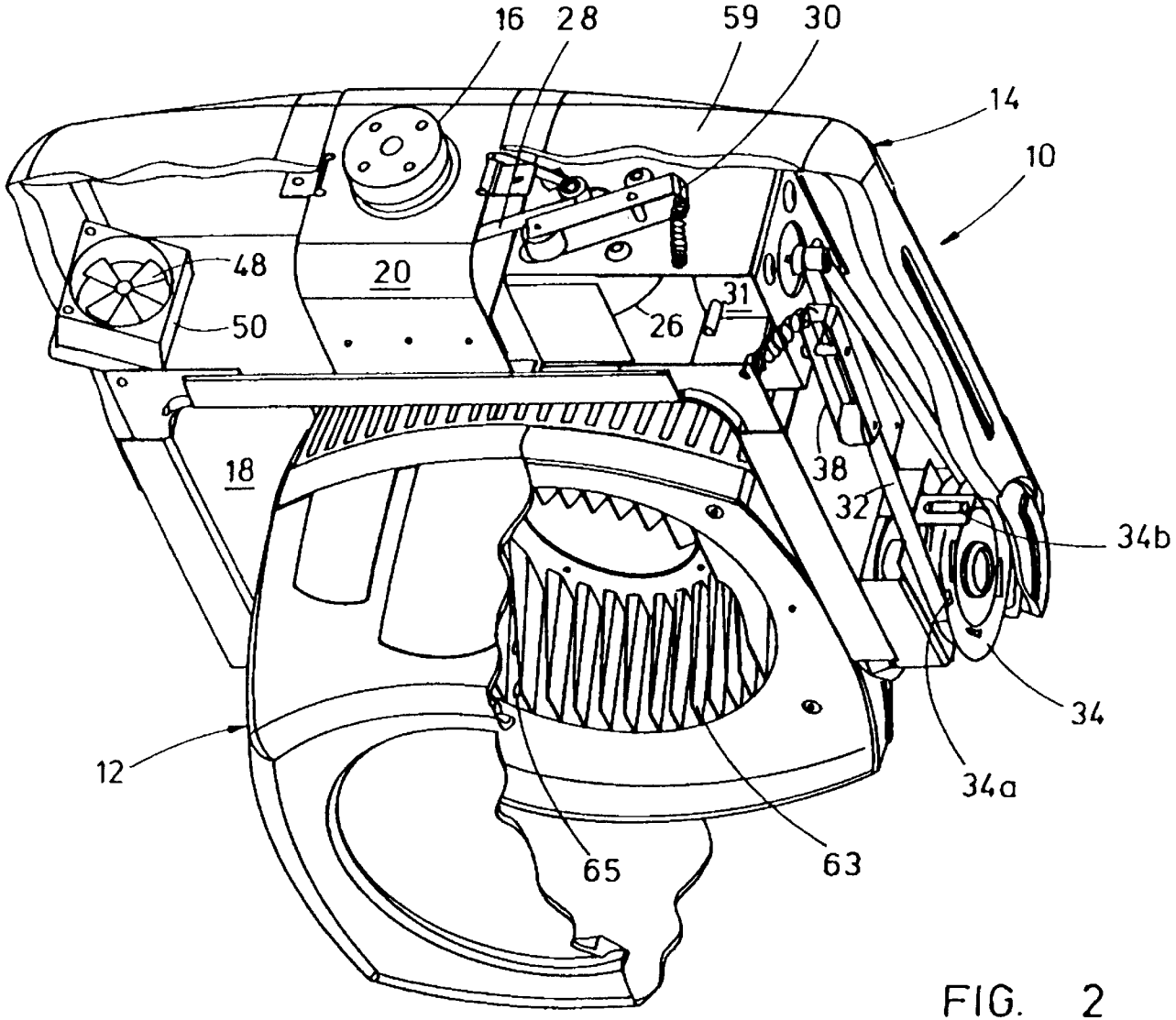
FIG. 2 is a perspective view, with partial cutaway portions, illustrating an embodiment of the luminaire of this invention.

Referring now to the drawings, FIGS. 1 and 2 illustrate the wash luminaire of the present invention, generally designated 10. Luminaire 10 comprises a housing 12 connected to a yoke 14 which may be suspended from a supporting truss (not shown) by means of a clamp (also not shown) attached to yoke 14 at connector 16.

Yoke 14 comprises a suitable metal frame 18 including a metal bracket 20 to reinforce yoke 14. Connector 16 is bearing mounted and connected by means of a shaft 22 to a gear 24 positioned adjacent bracket 20. Gear 24 includes a notch (not shown) which operates with an adjacent position sensor (not shown) for pan position control. A motor 26, supported by frame 18, drives belt 28 to rotate gear 24 for the purpose of providing a 360 degree rotation about the centroidal axis P of shaft 22. This provides the pan capability to luminaire 10. A suitable idler arrangement 30 is provided to engage belt 28.

Another motor 31, also supported by frame 18, drives belt 32 to rotate gear 34 for the purpose of providing at least a 270 degree rotation about the centroidal axis T of a shaft 36. Similar to gear 24, gear 34 includes a notch 34*a* which operates with an adjacent position sensor 34*b* for tilt position control. This provides the tilt capability to luminaire 10. Another suitable idler arrangement 38 is provided to engage belt 32. A travel stop 37 is connected to the tilt mechanism to limit movement of luminaire 10 to a desired tilt angle.

A manual off-on switch or breaker 52 is also mounted externally on yoke 14. A cooling fan 48 mounted in a housing 50 is operable to draw cooling air into yoke 14 through a plurality of vents 54, across the internal components of yoke 14, and outwardly through a similar plurality of vents 56. A cover 59, formed of a rigid synthetic material, which includes vents 54 and 56, encloses yoke 14 and the above described components.

Figure 3:
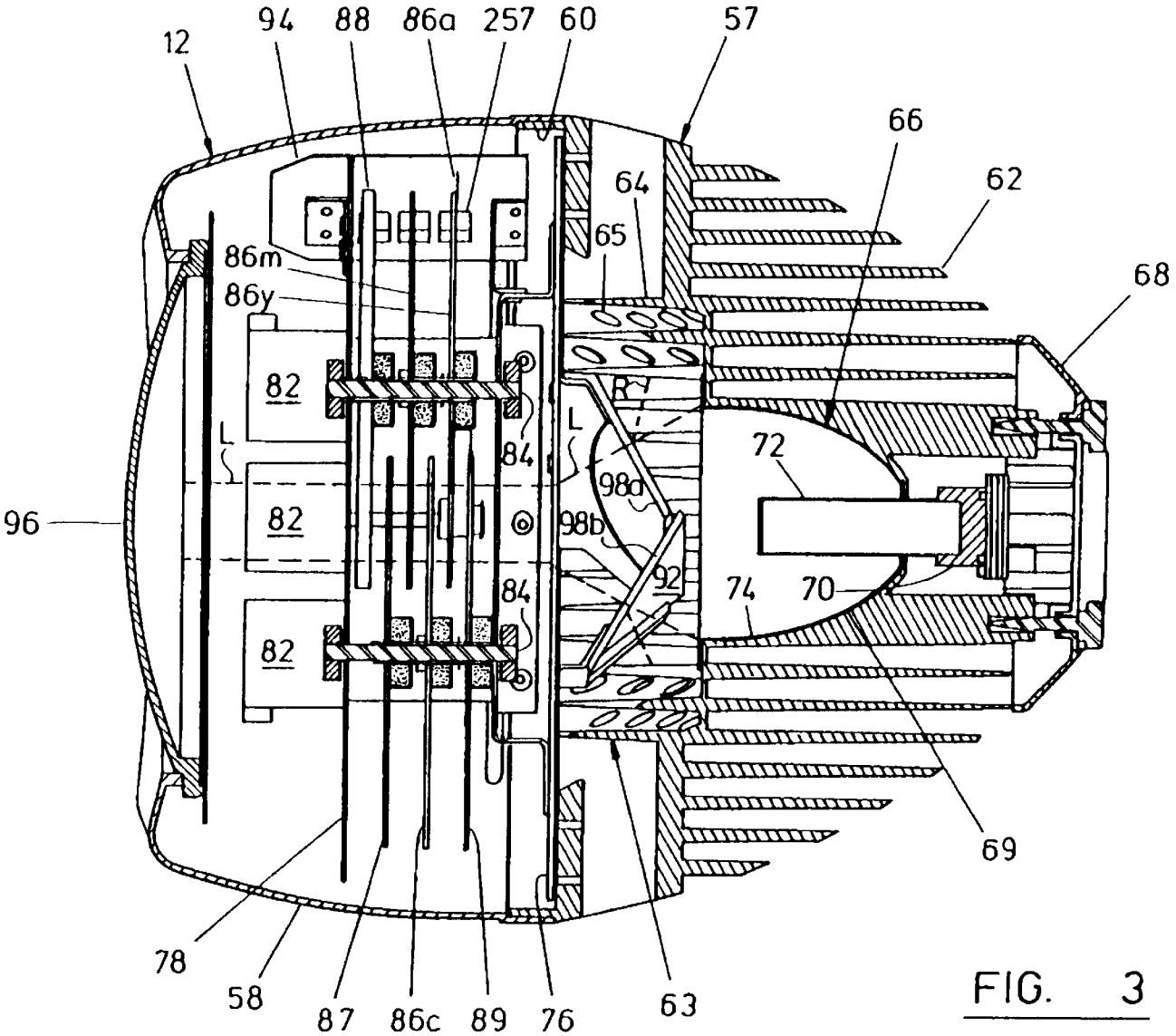
FIG. 3 is a cross-sectional view, illustrating an embodiment of the housing of this invention.
Figure 4:
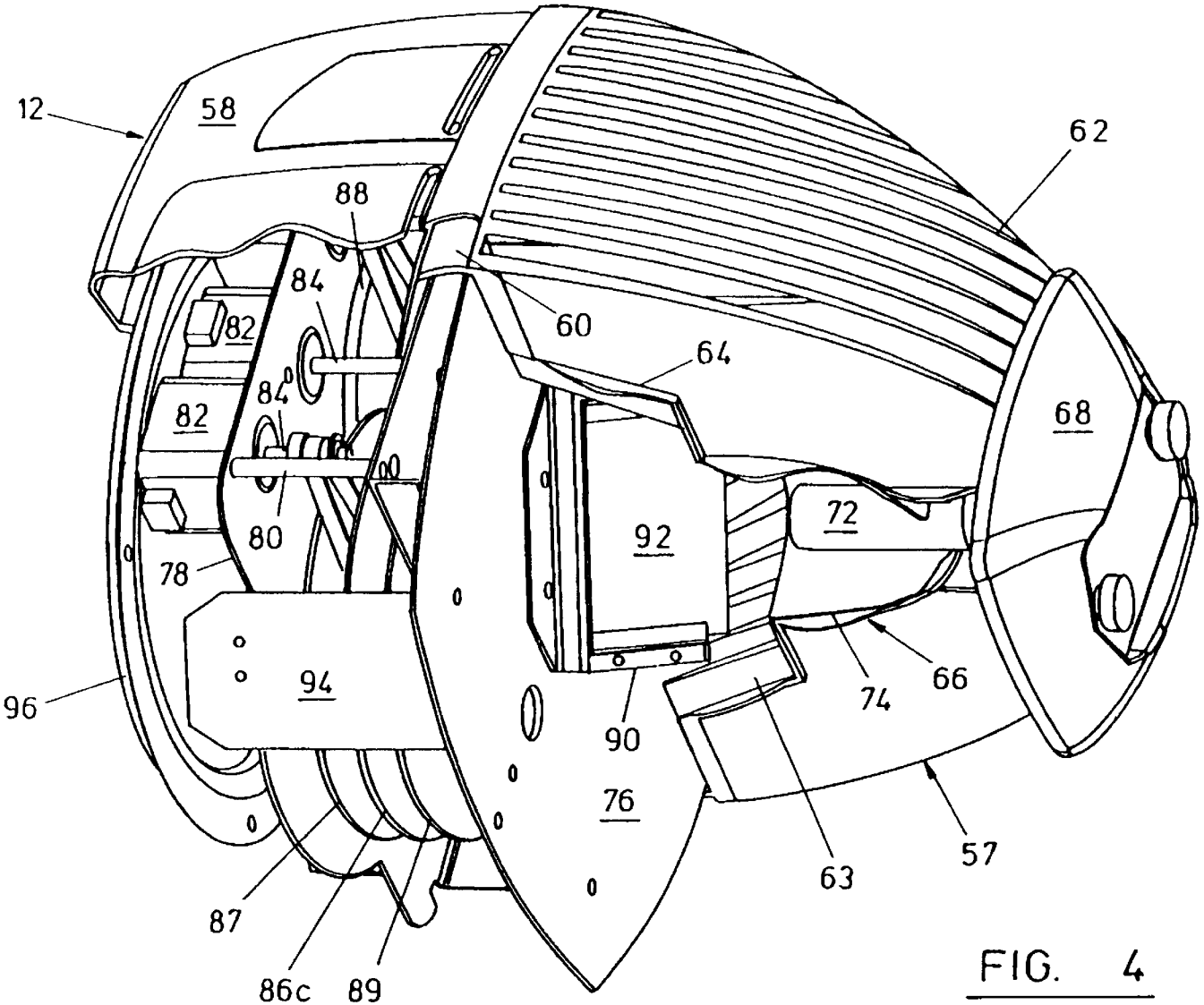
FIG. 4 is a perspective view, with partial cutaway portions, illustrating an embodiment of the housing of this invention.
Figure 5:
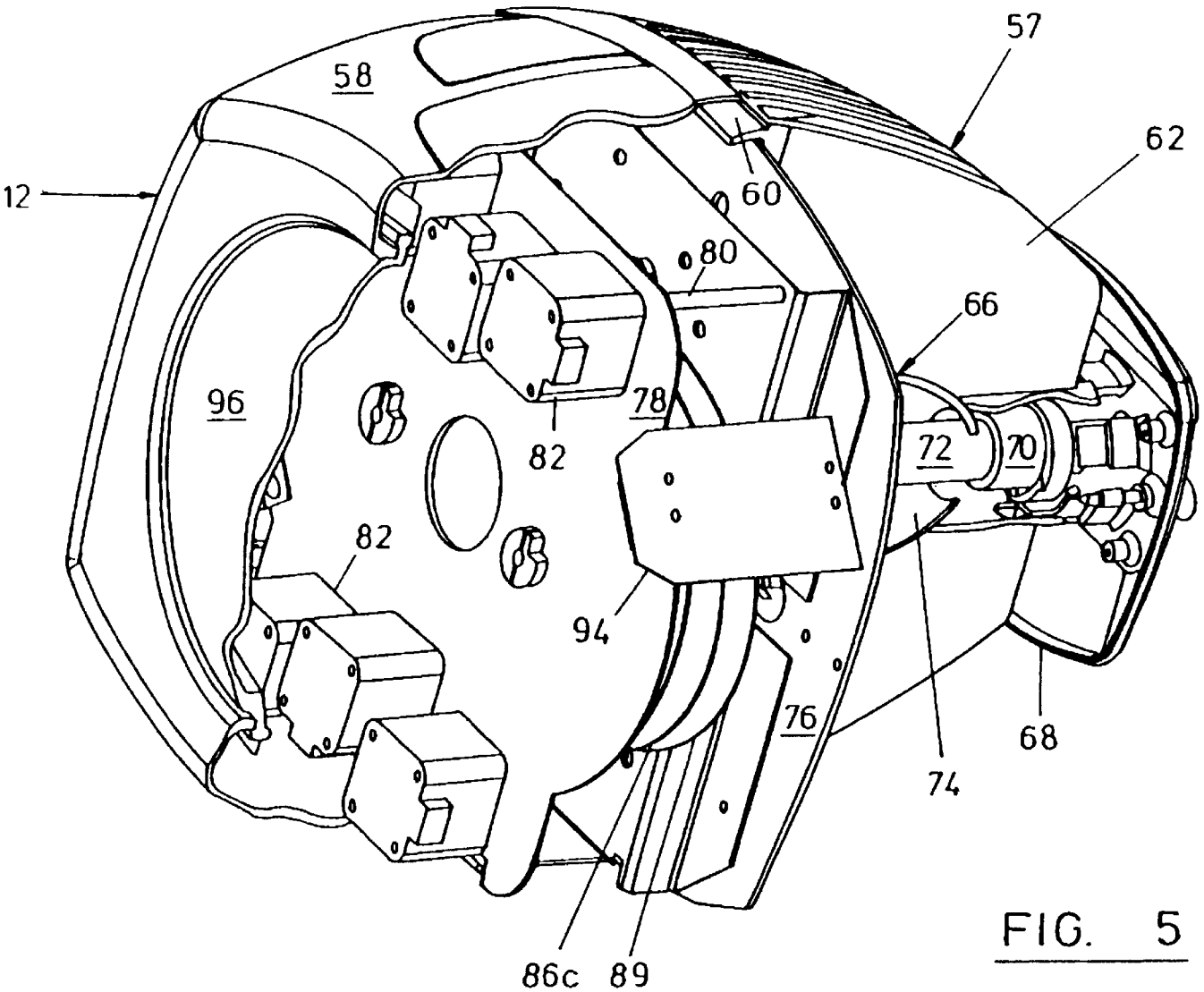
FIG. 5 is another perspective view, with partial cutaway portions, illustrating an embodiment of the housing of this invention.

In FIGS. 3, 4, and 5, housing 12 is illustrated and generally comprises an aluminum casting 57 and a bezel 58, formed of a suitable rigid synthetic material. Casting 57 includes a base 60, at a first end, from which a first plurality of contoured external cooling fins 62 extend. A stepped annular relief 66 is provided within casting 57 and includes an annular portion 64 and a truncated elliptical portion 69. Annular portion 64 also includes cooling vents 65. A second plurality of internal cooling fins 63 are disposed about an inner annular periphery of annular portion 64. First and second fins 62, 63, respectively, are aligned.

An aluminum end cap 68 is mounted on a second end of casting 57. A lamp base 70 and lamp 72 are mounted on end cap 68. Lamp 72 extends into open annular relief 66. An elliptical reflector 74 is also mounted in elliptical portion 69 so as to suitably surround lamp 72. Lamp 72 is powered by AC power in a conventional manner.

An aluminum heat blocking wall, or hot plate 76, is mounted on the first end of casting 57, and is spaced from a motor mounting plate 78 by spacer elements 80. A plurality of motors 82 are mounted on motor mounting plate 78 and rotating shafts 84, extending from motors 82, are operable to be belt driven to rotate a plurality of staggered colored filters 86, a pair of overlapping, staggered lenses 87, 88 and a conventional color wheel 89. Tabs, such as tab 86*a*, on color filter 86, are provided on these shaft mounted, rotating lenses, filters, etc., to operate with a plurality of respective adjacent position sensors 257 mounted on a pair of motor/driver sensor boards 94 mounted between plates 76, 78 for the purpose of sensing the positions of each of the shaft mounted rotating devices including color filters 86, etc.

Light beam L, FIG. 3, is condensed to a diameter of about 1.25 inches in diameter where is exits casting 57 at an opening 76*a* in hot plate 76. The beam then passes through the series of wheels; color filters, lens, etc. In the embodiment of FIG. 3, bezel 58 houses a series of 6 wheels. Color wheel 89, dichroic coated color filter (yellow) 86*y*, dichroic coated color filter (cyan) 86*c*, dichroic coated color filter (magenta) 86*m*, and lenses 87 and 88. Three of these wheels are mounted on shaft 84 and another three are mounted on a corresponding shaft 84. The 2 sets of 3 wheels are interleaved, i.e. partially overlapped, in known fashion, to optimize the number of surfaces exposed to beam L. The positions of the three wheels on one shaft 84 are sensed by their respective sensors 257 on one of the boards 94, and the positions of the other three wheels on the other shaft 84 are similarly sensed by their respective sensors 257.

Figure 6:
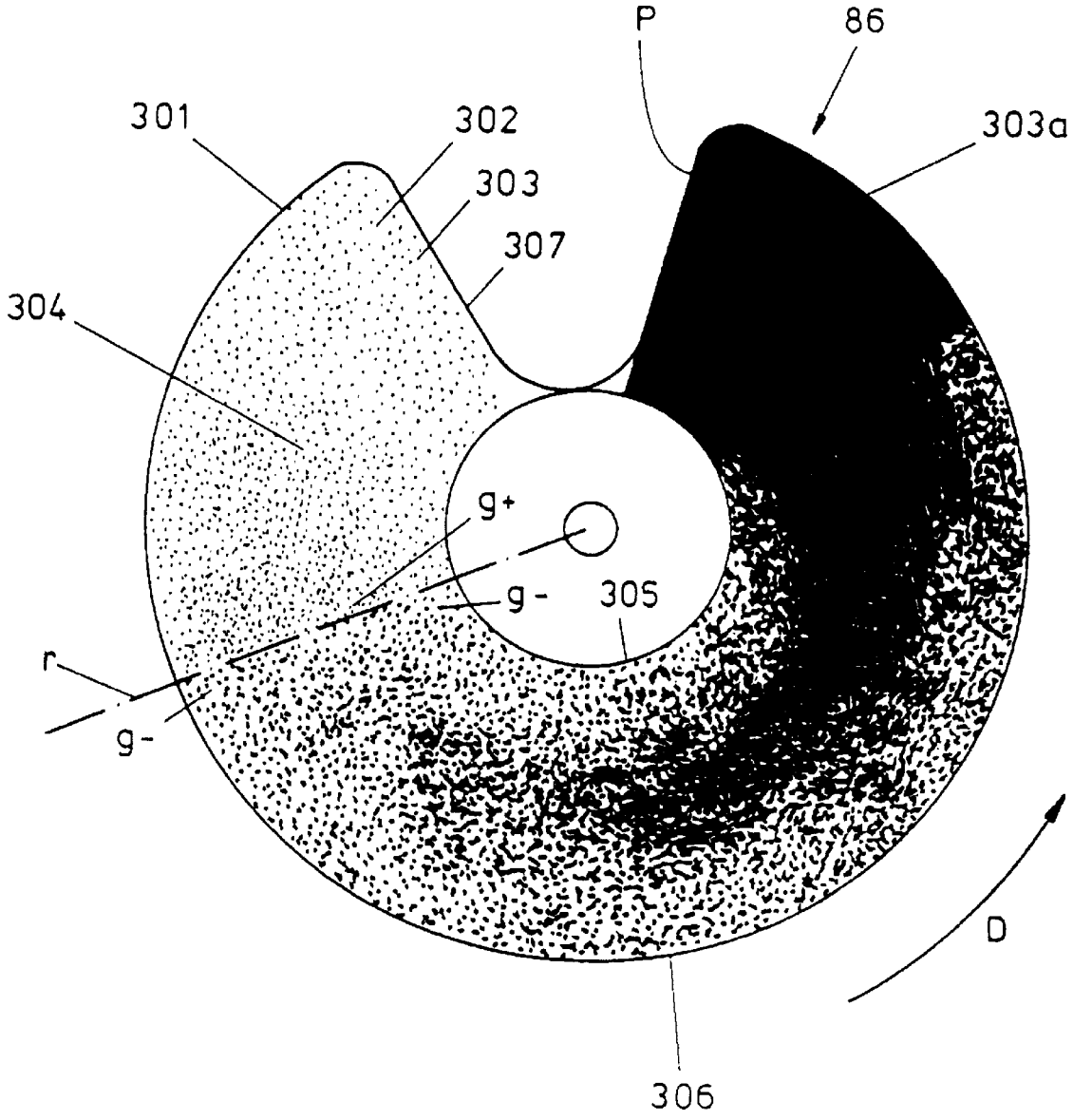
FIG. 6 is a plan view illustrating an embodiment of the color filter of this invention.

Color filters 86*y*, 86*c* and 86*m*, FIG. 6 comprise a disc-shaped borosilicate glass substrate 301 having a planar surface 302 which includes a photolithographically etched film 303 deposited thereon. Film 303 forms a Gausian pattern arcuate band 304 extending around a substantial portion of planar surface 302. Band 304 has an inner edge 305 and an outer edge 306 and the density of film 303 is greater in an area designated g+ along a radius r between inner edge 305 and outer edge 306 and less in an area designated g− along radius r at inner edge 305 and less in a corresponding area g− along radius r at outer edge 306. A portion of substrate 301 is cut away to form a notch 307 which interrupts arcuate band 304. A portion p of planar surface 302 adjacent notch 307 is coated with a solid film 303*a* having no pattern as on the etched film 303 in band 304.

Color filters 86*y*, 86*c* and 86*m* are used in combination with lamp 72 to produce desired color effects. Beam L, produced by lamp 72, is circular and has a typical power gradient, which is not uniform across the beam. A ratio of power from the center of the beam to beam edge is often on the order of 50%. Known variable density filters which do not address the power gradient of the beam, produce results which are non-uniform and leave an apparent white spot in the center of the beam while darkening the beam edge which makes the coloration objectionable.

Advantageously, the Gausian patterning of the color filters of this invention is coincident with the inverse of the power gradient of the beam L. That is, the color filter gradient is greatest toward the center of the band 304 where it crosses the maximum power point of the beam L. In this manner, the maximum power of the beam L is coincident with the maximum filtering effect of filters 86*y*, 86*c* and 86*m*.

Saturation of the Gausian color pattern increases proportionally as the filter is rotated in a direction represented by directional arrow D, FIG. 6, culminating in 100% saturation at about 300 degrees of angular travel where portion p of planar surface 302 is coated with solid film 303*a*.

If it is desired, a bracket 90 is mounted on hot plate 76 to position a heat filter 92 to reflect IR radiation R back to the cooling fins 63, 62 to be dissipated from housing 12. Heat filter 92 comprises the bracket 90, FIGS. 3 and 4, which is generally of an A-frame construction and includes a first filter 98*a* mounted at about a ninety degree angle relative to a second filter 98*b*. Filter 92 is used to reflect damaging infrared radiation R away from the previously mentioned heat sensitive optical components mounted on shafts 84. Thus, these filters are at an angle to light beam L passing therethrough. The result is a reflection of IR radiation outwardly toward the fins, as is best shown in FIG. 3. First and second filters 98*a,* 98*b,* respectively are preferably formed of a suitable 1.75 mm thick substrate of borosilicate glass material and has a thin film dichroic coating on both sides. The coating on one side facing lamp 72, will provide infrared reflectance of from about 730 nm to about 1,050 nm. The coating in the opposite side will provide reflectance of from about 1,050 nm to about 1,700 nm.

Figure 11:
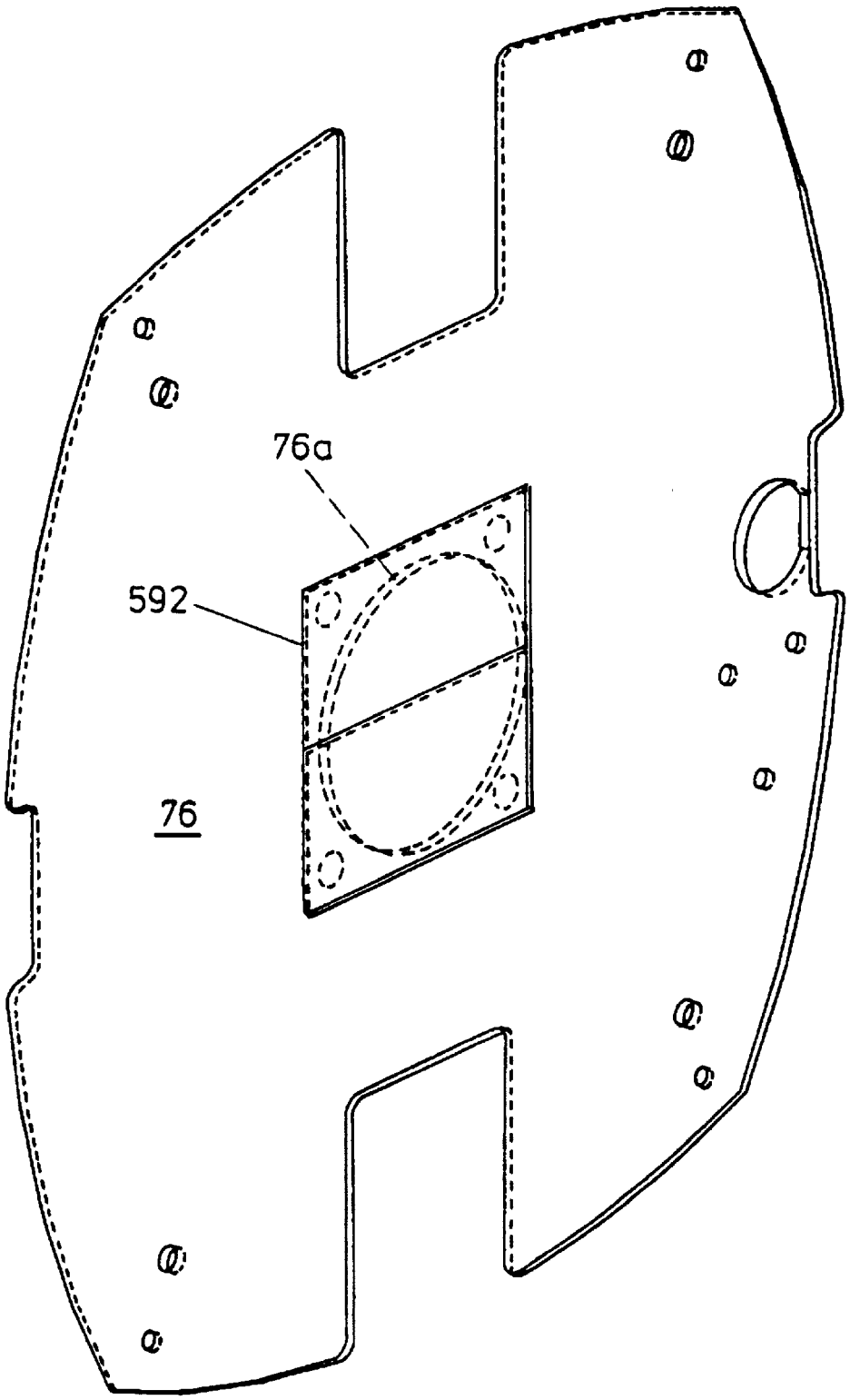
FIG. 11 is a perspective view illustrating an embodiment of the hot plate and ultra violet filter of this invention.

Heat filter 92 can be eliminated. However, preferably a filter for blocking ultra violet rays from reaching the color wheels and their drive systems may be utilized. Such a filter 592, FIG. 11, may take the form of a borosilicate glass material positioned between the lamp and the color wheels. For example, the filter 592 may be suitably mounted on the hot plate 76 in place of heat filter 92 in position to filter light beam L before it passes through opening 76*a* in hot plate 76.

Figure 7A:
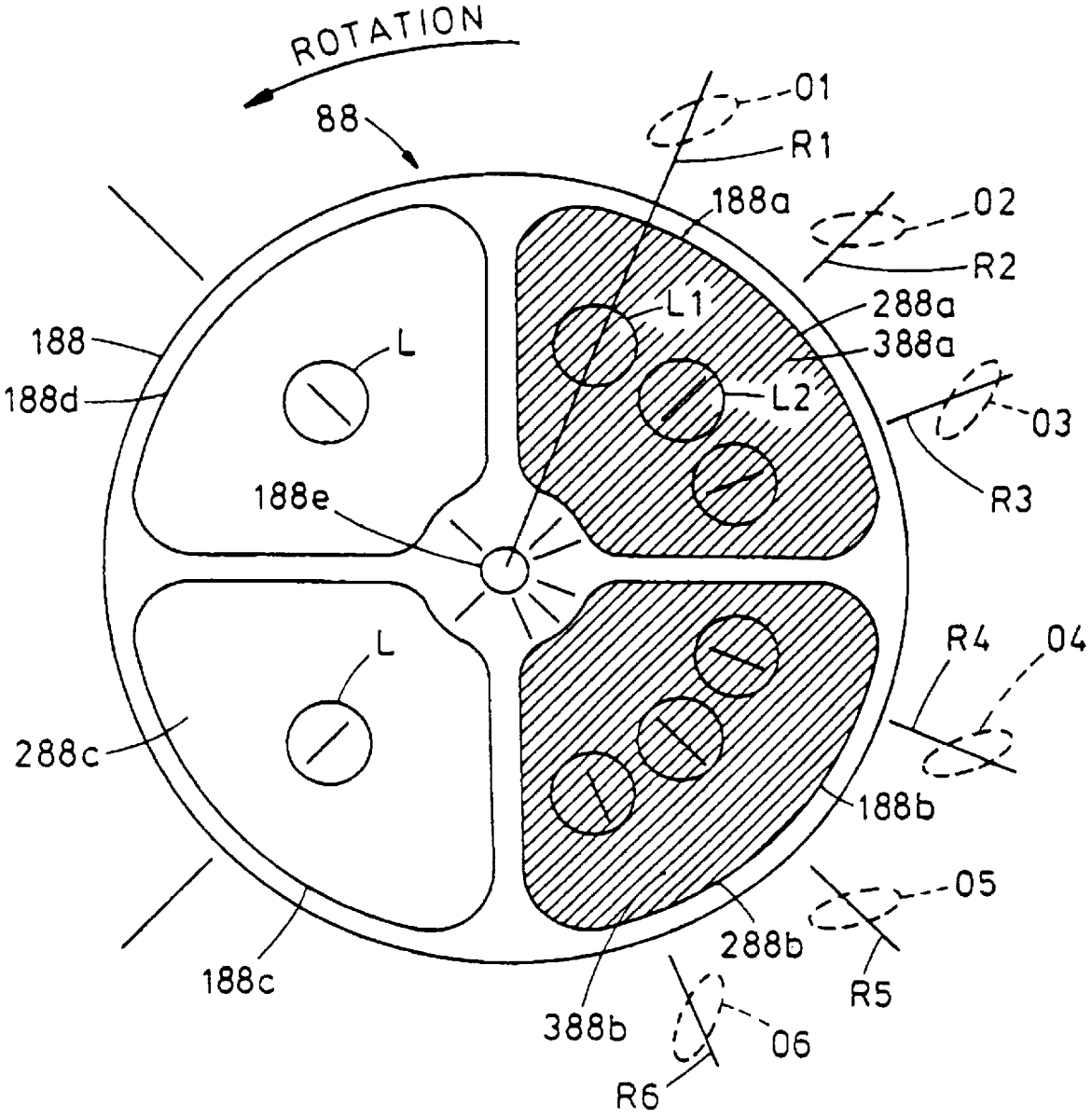
FIG. 7A is a planar view illustrating an embodiment of the rotatable lenticular lens device of this invention.

A lenticular lens device 88, FIG. 7A is rotatably mounted adjacent one side of motor mounting plate 78. Lens device 88 is mounted on one of the shafts 84 which is rotatably driven by one of the motors 82 suitably attached on another side of motor mounting plate 78. Lens device 88 comprises a disc shape and is formed of an aluminum or other suitable metal retainer 188 having a plurality of openings 188*a,* 188*b,* 188*c,* 188*d* formed therein. An aperture 188*e* in the geometric center is for receiving shaft 84 whereby lens device 88 is rotatable. One of the openings 188*a* includes a lenticular lens element 288*a* formed of a suitable high temperature glass having a plurality of substantially parallel radially extending grooves or lenticules 388*a* formed therein. Another of the openings 188*b* includes substantially the same lenticular lens element 288*b* but having the grooves or lenticules 388*b* oriented at 90 degrees relative to lenticules 388*a*. Lenticular lens elements 288*a* and 288*b* will change the geometric shape from a circular to an elongated ellipsoidal shape. Still another of the openings 188*c* includes either a suitable well know frost material 288*c,* FIG. 7A, which will diffuse and soften the beam L and spread out the beam angle but will not affect the geometric shape of the beam. The last of the openings 188*d* remains open and contains no lens element so that the light beam passing there through retains its normal lights pattern having a circular cross-sectional geometry. The lens elements 288*a,* 288*b,* 288*c* or 488*c* may be fixedly secured to retainer 188 by a suitable high temperature silicone based adhesive or may be removably secured by some suitable attachment device.

Figure 7B:
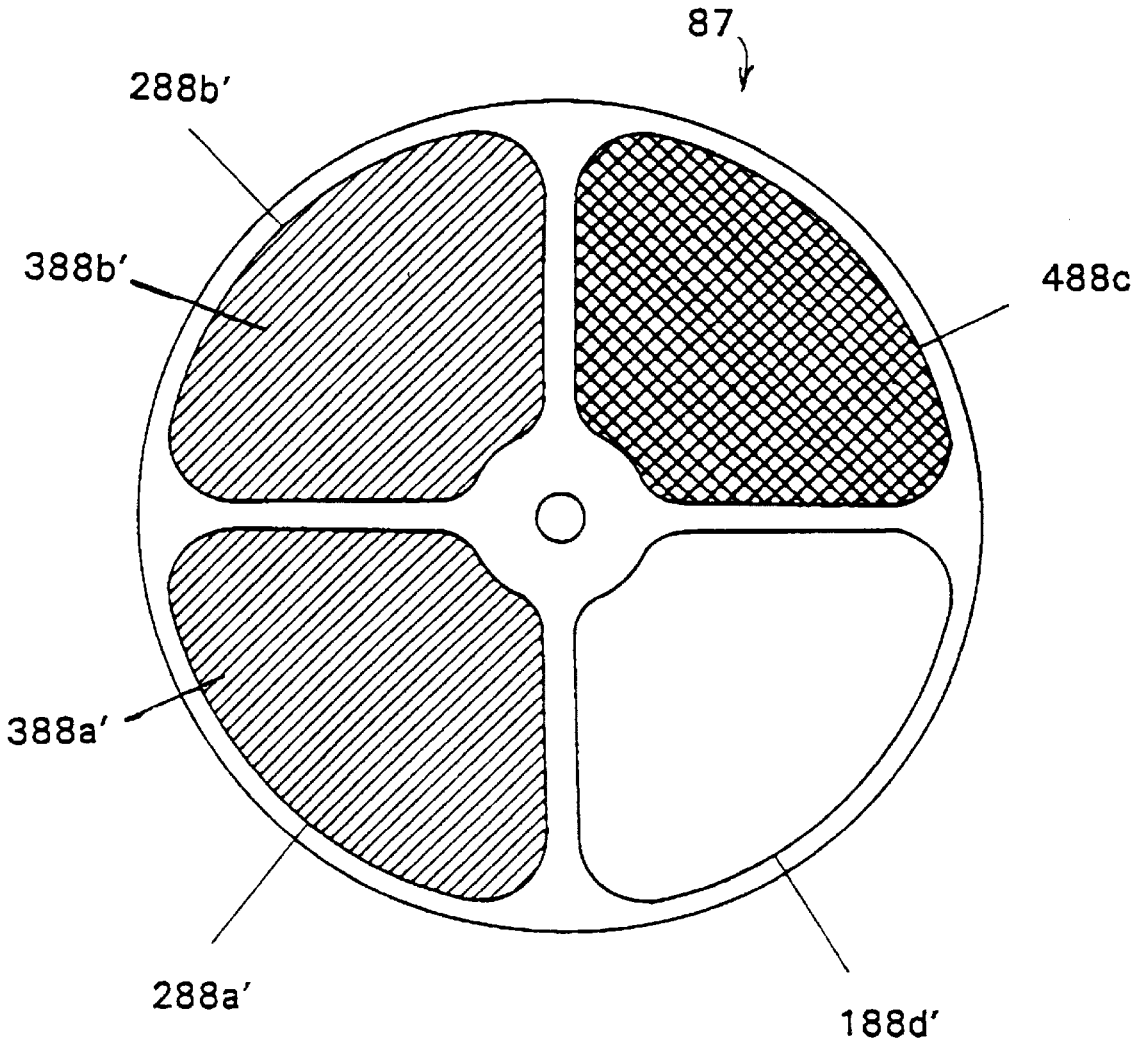
FIG. 7B is a planar view illustrating an embodiment of another rotatable lenticular lens device of this invention.

Another lenticular lens device 87, FIG. 7B is rotatably mounted similar to device 88 but staggered to overlap device 88. Lens device 87 is similar in construction to device 88 except that a homogeneous lens element 488*c* is provided in place of the frost material 288*c* of device 88. As it is known, the homogeneous lens element 488*c* includes an array of adjacent convex surfaces which function to change the magnification and increase the beam angle but will not affect the geometric shape of light beam L. As a result, lens device 87 includes a lenticular lens element 288*a'* having a plurality of substantially parallel radially extending grooves or lenticules 388*b'* formed therein and lenticular lens element 288*b'* having grooves or lenticules 388*b'* oriented at 90 degrees relative to lenticules 388*a'*. Homogeneous lens element 488*c* is provided instead of frost and 188*d'* remains open.

In FIGS. 7A and 7B lens devices 87, 88 are illustrated. When the device 88 is mounted in fixture 10 for rotation on shaft 84 engaged in aperture 188*e,* a fixed beam of light L passes through lens device 88 as the device 88 is rotated. When opening 188*d* is in the path of beam L, there is no affect on the beam since there is no lens in opening 188*d*. When device 88 is rotated to a position where frosted lens 288*c* interrupts beam L, the beam angle is affected but the geometric shape of beam L is unchanged. However, when lenticular lens elements 288*a* and/or 288*b* interrupt the beam L, the normally projected circular geometric shape of beam L is changed to an oblong or ellipsoidal shape O as illustrated in phantom in FIG. 7A. Furthermore, as the lens device 88 is rotated through fixed beam L, the oblong shape of beam O changes in orientation.

For purposes of illustration only, several radii are shown in FIG. 7A and extend outwardly through six different positions where rotating lens device interrupts fixed beam L. In a first position the orientation of altered beam O1 on radius R1 is aligned with the direction of lenticules 388*a* as they extend across beam L1 which remains fixed. As viewed in FIG. 7A, the oblong projected beam O1 is slightly canted to the right with reference to radius R1. In a second position, the orientation of altered beam O2 on radius R2 is aligned with the direction of lenticules 388*a* as they extend across fixed beam L2 which is actually in the same fixed position as the beam designated L or L1. As viewed in FIG. 7A, the longitudinal axis of the projected beam O2 is vertically aligned with reference to radius R2 and as the lens device 88 is further rotated, the oblong projected beam O3, O4, O5 and O6 constantly changes orientation in the direction of rotation with reference to its respective radii R3, R4, R5 and R6 due to the changing orientation of lenticules 388*a* and 388*b* extending across the fixed light beam.

With the foregoing orientation description in mind, it can be appreciated that the overlapping lens devices 87, 88 provide a wide variety of beam shapes including combinations of beam shapes heretofore not available. The combinations include circular and ellipsoidal beam shapes with or without frost, with or without increased beam angle, or with overlapping ellipsoidal beam shapes, for example where lens element 288*a* overlaps lens element 288*b'* wherein the ellipsoidal beam shape provided by one lenticular lens element, i.e. 288*a,* can extend in a longitudinal direction which is angularly disposed relative to the longitudinal direction of the ellipsoidal beam shape provided by another lenticular lens element, i.e. 288*b',* of an overlapping lens device. This unique combination provides enhanced lighting effects not previously available.

Figure 8:
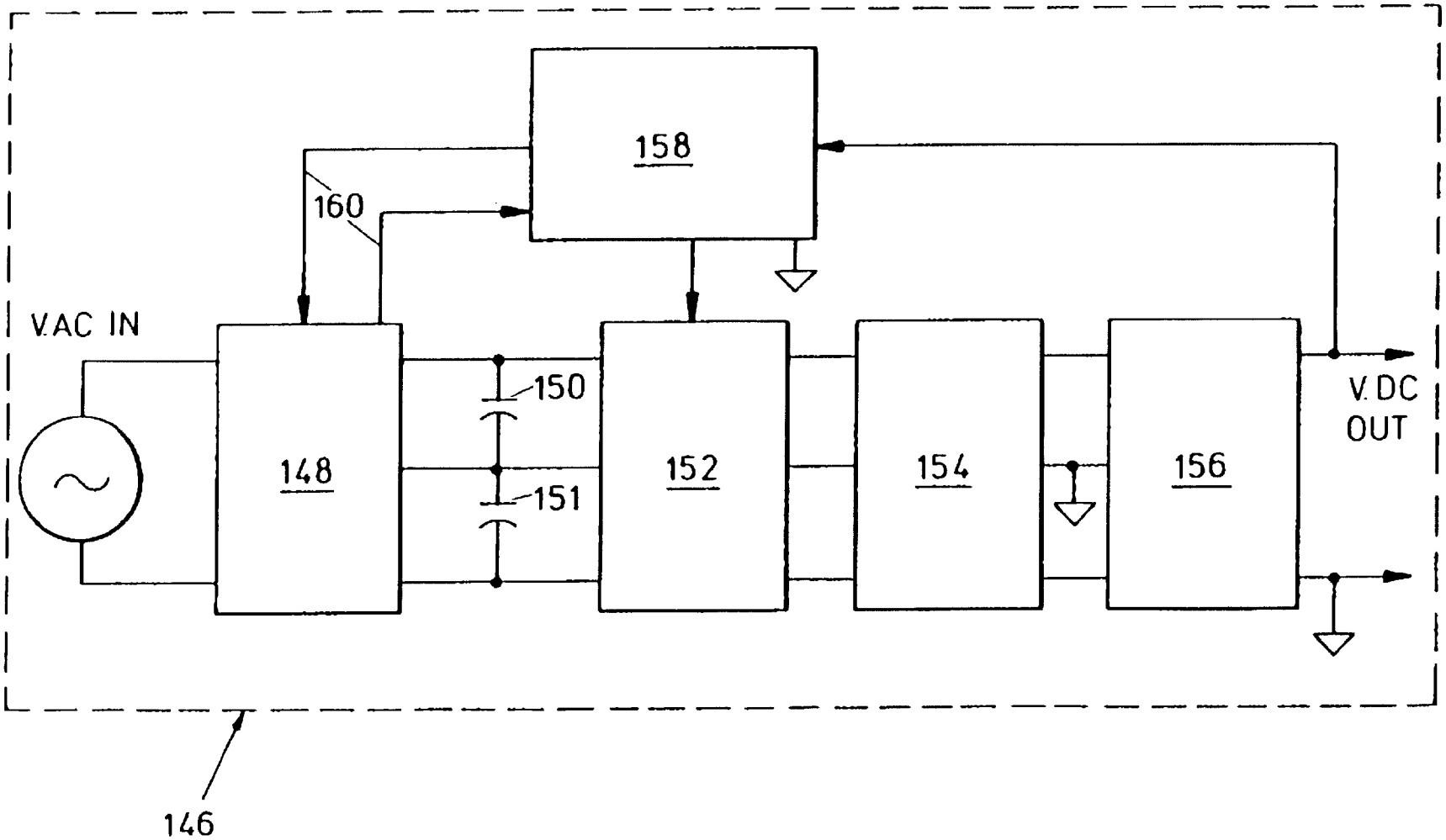
FIG. 8 is a diagrammatic view illustrating an embodiment of the power board of this invention.

Also included in yoke 14 is a power supply board 146, best shown in FIG. 8, mounted behind a portion designated 46 of metal frame 18. Power supply board 146 is the motor and logic power supply for movement of luminaire 10. Power supplied to board 146 may be 100 to 240 VAC (50/60 Hz). A voltage selection rectification 148, changes AC to DC voltage and operates to double the voltage if less than 150 VAC. Output is stored in capacitors 150, 151 and then a half bridge 152 switches the DC back to AC voltage at 40 kHz. The 40 kHz goes into a transformer 154 which steps the voltage down and isolates the live voltage from the low voltage output circuit. The AC voltage is rectified back to DC voltage and filtered via an inductor-capacitor arrangement at 156. A voltage mode, pulse width modulator controller 158 is responsible for the feedback of the output voltage and controls the half bridge 152 to produce a constant output voltage. Also, a voltage sensor for doubler circuit control is provided at 160.

Figure 9:
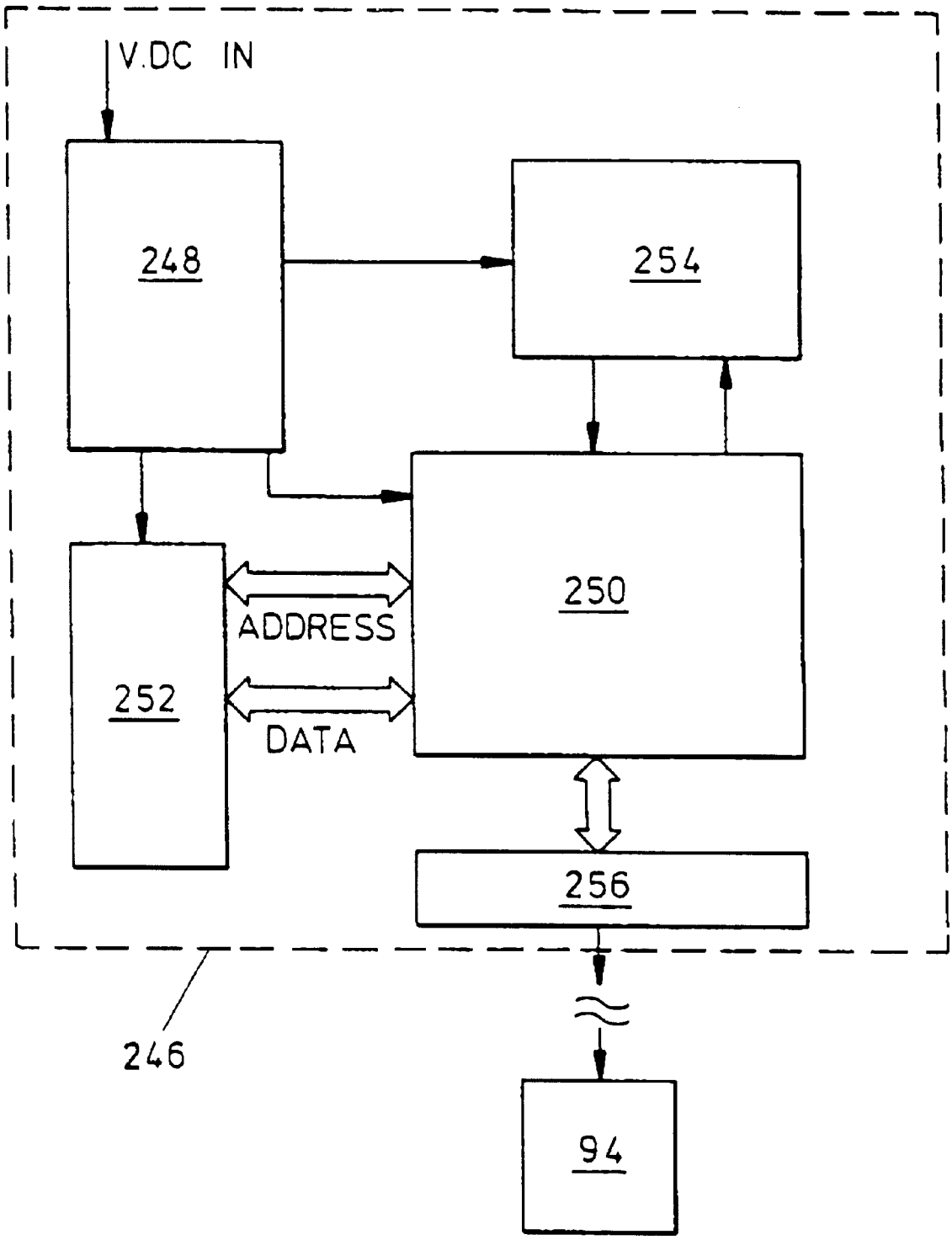
FIG. 9 is a diagrammatic view illustrating an embodiment of the logic board of this invention.

A logic board 246, best shown in FIG. 9, is mounted in yoke 14 behind a portion designated 40, of metal frame 18. The logic board is operably connected to a controller and controls the above-mentioned pan and tilt, and also controls color wheels, etc., and other operable components of the luminaire 10. Power from power board 146 is fed to logic board 26 at from about 9VDC to about 40VDC through a voltage regulator circuit 248. The power is then communicated to a commercially available embedded microporcessor 250. The power is also communicated to a memory block 252 which comprises 3 different types of memory including Static RAM, Flash ROM and EPROM. The memory 252 is utilized by the microprocessor 250 to perform read/write operations on the code and data stored in the 250 memory which signals pan and tilt commands to luminaire 10. A serial transceiver 254 provides RS 485 compatible signals to industry standard USITT DMX512 controllers and exchanges (receives and transmits) information with microprocessor 250. A slave serial module 256 receives information from microprocessor 250 and serializes data received and sends it out over 5 wires to slave modules including motor driver/sensor boards 94 which include infrared photo interrupter sensors 257, FIG. 3, which respond to tabs and/or notches on component parts of luminaire 10 such as notch 34*a* formed in gear 34, FIG. 2 or tab 86*a* on color filter 86, FIG. 3, which tells the microprocessor 250 the initial (zero or homing) position of motors 26, 82, respectively. The serial module 256 retrieves the position information from sensors 257 and sends it to the microprocessor 250 which determines whether to continue to move the filter or gear or to look for the tab/notch.

Figure 10:
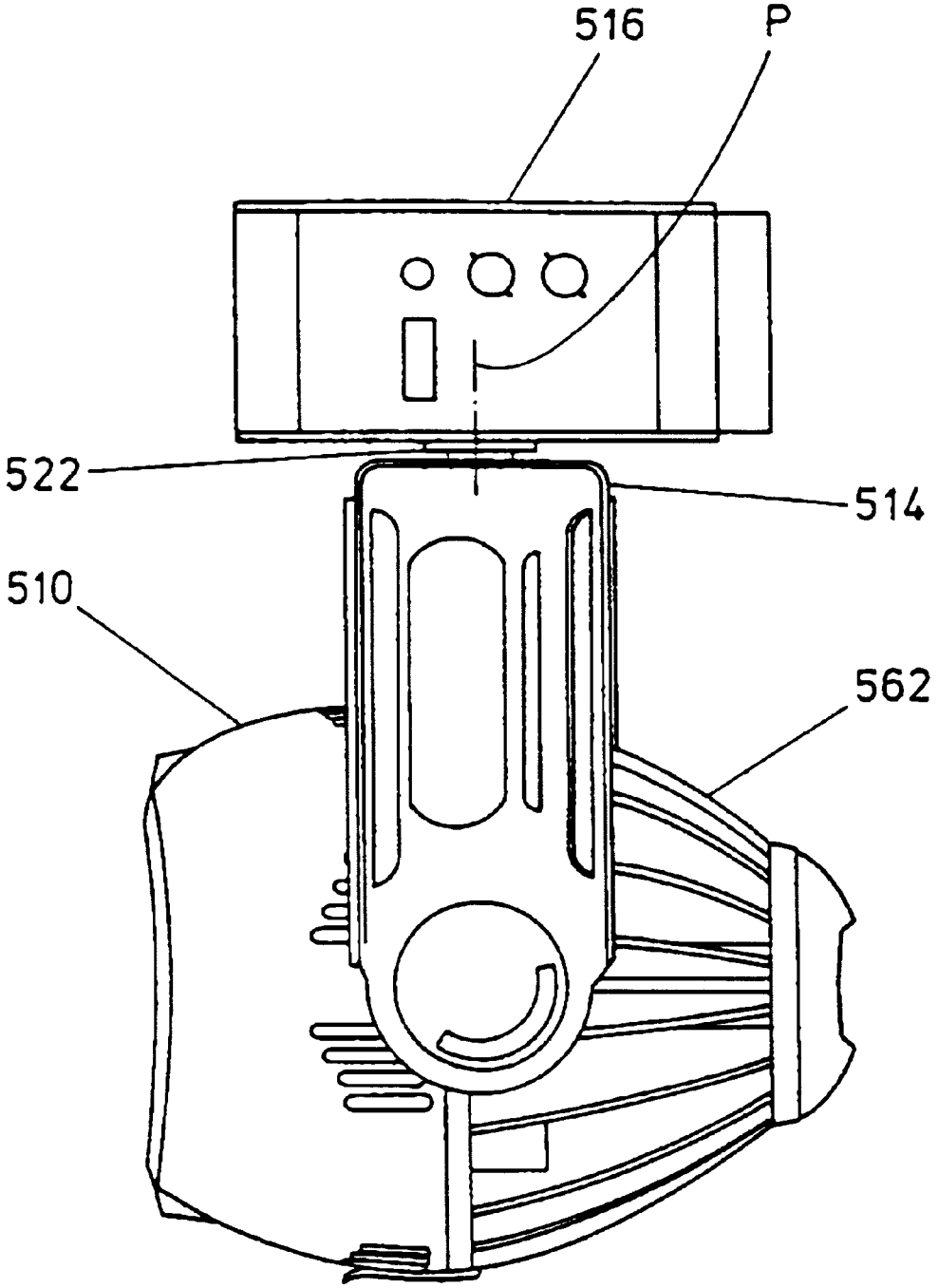
FIG. 10 is a side elevation view illustrating another embodiment of the luminaire of this invention.

Another arrangement is illustrated in FIG. 10, and includes a fixture housing 510, a yoke 514 and an electronics housing 516. In this arrangement, power board 146 and logic board 246, FIGS. 8 and 9 are positioned in electronics housing 516. Also, in housing 516 are the previously described motor 26, bolt 28 and gear 24 arrangement, see FIG. 1, for driving the 360 degree pan position control which rotates housing 510 about centroidal axis P of shaft 522 which interconnects yoke 514 and electronics housing 516. No fan such as fan 48, described previously as being positioned in yoke 14, and cooperative vents 54, 56, are needed with removal of the electronics including logic board 246 and power board 146 from the yoke. The previously described tilt mechanism, see FIG. 1, including motor 31, belt 32 and gear 34, would however remain in the yoke to provide the 270 degree rotation. Housing 510 may also include contoured, radially directed cooling fins 562 formed as part of aluminum casting 557.

A stationary lens 96, is mounted in bezel 58, best shown in FIG. 1. Lens 96 is a common light diffusing lens similar to a lens used in an automotive headlight. Such lenses are commercially available. The above described combination of overlapping, rotating lenses 87, 88 and stationary lens 96 provide a beam angle which is preferably from about 10 degrees to about 60 degrees. This can be varied by rotation of lenses 87, 88 and enhanced by interchanging a selected diffusing lens 96.

While this invention has been illustrated and described in accordance with a preferred embodiment, it is recognized that variations and changes may be made therein without departing from the invention as set forth in the claims.

Having described the invention, what is claimed is:

1. A light fixture having multiple lens apparatus for changing a shape projected by a beam of light comprising:

means for projecting a generally circular beam of light, and overlapping lens devices each including a lenticular lens element movable into a position to interrupt the beam of light altering a circular beam pattern to a generally ellipsoidal beam pattern; and motors to continuously move at least one of the lens devices relative to the beam of light.

2. The light fixture as defined in claim 1 wherein each of the lens devices are mounted in rotational mounts capable of relative adjacent rotation.

3. The light fixtures of claim 1 wherein the continuous movement is from one position to another.

4. A light fixture having multiple lens apparatus for changing a shape projected by a beam of light comprising:

means for projecting a generally circular beam of light, and overlapping lens devices each including a lenticular lens element movable into a position to interrupt the beam of light altering a circular beam pattern to a generally ellipsoidal beam pattern; and motors to continuously move at least each lens devices relative to the beam of light.

5. The light fixtures of claim 4 wherein the continuous movement of one lens element is from one position to another and the continuous movement of the other lens element if from one position to another.

6. A light fixture having multiple lens apparatus for changing a shape projected by a beam of light comprising:

means for projecting a generally circular beam of light, and overlapping lens devices each including a lenticular lens element movable into a position to interrupt the beam of light altering a circular beam pattern to a generally ellipsoidal beam pattern; and motors to continuously move at least each lens devices relative to the beam of light and relative to each other.

7. The light fixtures of claim 4 wherein the continuous movement of one lens element is from one position to another and the continuous movement of the other lens element is from one position to another.

* * * * *